US006424098B1

(12) United States Patent
Beland et al.

(10) Patent No.: US 6,424,098 B1
(45) **Date of Patent: *Jul. 23, 2002**

(54) ILLUMINATION SYSTEM WITH SEVERAL GAS DISCHARGE TUBES

(75) Inventors: Robert Beland, Ste-Marthe sur le Lac; Alain Seery, Rosemere, both of (CA)

(73) Assignee: Transfotec International LTEE, St.-Eustache (CA)

( * ) Notice: Subject to any disclaimer, the term of this patent is extended or adjusted under 35 U.S.C. 154(b) by 0 days.

This patent is subject to a terminal disclaimer.

(21) Appl. No.: 09/560,829

(22) Filed: Apr. 28, 2000

Related U.S. Application Data

(60) Provisional application No. 60/131,860, filed on Apr. 29, 1999.

(51) Int. Cl.[7] ..... H05B 37/02

(52) U.S. Cl. ..... 315/224; 315/312; 315/324; 315/200 R; 315/291

(58) Field of Search ..... 315/291, 307, 315/312, 324, 276, 224, 177, 57, 200 R

(56) References Cited

U.S. PATENT DOCUMENTS

| | | | | |
|---|---|---|---|---|
| 4,132,925 A | | 1/1979 | Schmutzer et al. | 315/208 |
| 4,259,616 A | | 3/1981 | Smith | 315/256 |
| 4,641,061 A | * | 2/1987 | Munson | 315/210 |
| 4,751,398 A | * | 6/1988 | Ertz, III | 307/66 |
| 4,904,904 A | | 2/1990 | Zarate | 315/219 |
| 5,416,388 A | | 5/1995 | Shackle | 315/219 |
| 5,621,281 A | * | 4/1997 | Kawabata et al. | 315/311 |
| 6,144,170 A | * | 11/2000 | Beland et al. | 315/276 |

FOREIGN PATENT DOCUMENTS

| | | | |
|---|---|---|---|
| GB | 2 114 385 A | 8/1983 | H05B/41/14 |

* cited by examiner

*Primary Examiner*—Don Wong
*Assistant Examiner*—Tuyet T. Vo
(74) *Attorney, Agent, or Firm*—Finnegan, Henderson, Farabow, Garrett, & Dunner, L.L.P.

(57) ABSTRACT

A method and a system for providing electrical power to several gas discharge tubes, include a master power supply and several high-voltage modules. The master power supply is constructed and arranged to provide high-frequency and low-voltage power to the high-voltage modules. Each high-voltage module, in turn, provides high-frequency and high-voltage power to a gas discharge tube. The high-voltage modules include step-up transformers with their primary side connected in series to the output of the master power supply and their secondary sides connected to the gas discharge tubes.

37 Claims, 11 Drawing Sheets

| | |
|---|---|
| FIG. 4A | FIG. 4C |
| FIG. 4B | |

ILLUMINATION SYSTEM WITH SEVERAL GAS DISCHARGE TUBES

This application claims priority from U.S. application Ser. No. 60/131,860, filed on Apr. 29, 1999, which is incorporated by reference.

FIELD OF THE INVENTION

The present invention relates to a novel illumination system that includes several gas discharge tubes. The present invention also relates to a novel power supply for the illumination system.

BACKGROUND OF THE INVENTION

Lighting systems for indoor and outdoor illumination of advertising signs and for other purposes have been used for many decades. An illumination system may include several gas discharge tubes, such as cold cathode tubes or fluorescent tubes. A cold cathode tube is a sealed glass tube that is filled with inert gas, such as argon or neon, wherein different ionized gases provide light of different colors. A fluorescent tube is a sealed glass tube having its inner walls coated with phosphorus and the tube is filled with, for example, mercury vapor. Both types of tubes may be fabricated in many different shapes and sizes. The tubes include electrodes connected to a high-frequency, high-voltage power supply that provides a striking voltage and a running voltage. The gas inside the tubes is ionized so that the gas atoms or molecules are stimulated to emit light of a known wavelength. To ionize the inert gas, a striking voltage of approximately 1.5 times the running voltage is required. Once ionized, a constant current is preferably maintained across the gas tube at a running voltage. The striking and running voltages are proportional to the tube length and are typically in the range of several hundred to several thousand Volts. The luminous intensity of the ionized gas is proportional to the current that flows between the electrodes inside the tube.

For advertising purposes, each gas discharge tube may be located within a letter enclosure. The letter enclosure may be shaped in the form of a letter or may have a rectangular shape with a letter sign in front of the gas discharge tube. The effectiveness of an advertising sign also depends on having letters of various shapes and sizes emitting light of a selected intensity, which is usually equal for all letters. Typically, the individual gas discharge tubes are powered by high-frequency, high-voltage power supplies. The output from each power supply is connected to the tube electrodes using high-voltage GTO cables. These high-voltage cables require special installation and can have only a limited length due to safety requirements. To install an outside sign, each letter may require two GTO cables located in two separate and relatively large holes drilled through an external wall. Thus, installing a large number of letters or symbols may require a significant amount of time and possibly damage to the wall.

There is still a need for an illumination system that includes several gas discharge tubes, is easy to install and operates efficiently.

SUMMARY OF THE INVENTION

The present inventions relate to an illumination system and method for providing electrical power to several gas discharge tubes and for controlling operation of the gas discharge tubes. The present inventions also relate to a novel high-frequency power converter, and detection and control modules used in the above system. The detection module and a method detect one or several conditions occurring during the operation of an illumination system, including operation and fault conditions, such as an open circuit state, a short circuit state, an output loading state, a ground fault state, an inverter fail state, or a line over-voltage state.

The present invention also relate to a high-frequency low-voltage power supply arranged to operate with a plurality of high-voltage modules, wherein each high-voltage module is constructed to provide electrical power to at least one gas discharge tube. The high-voltage modules may be located several hundred feet away from the power supply. The power supply may be a high-frequency current source with a high power factor design. Upon detecting a fault condition, the power supply automatically shuts-off power generation. The present invention also relates to a high-voltage module connectable in series with other high-voltage modules and each arranged to provide high-frequency and high-voltage electrical power to a gas discharge tube.

According to one aspect, a system for providing electrical power to several gas discharge tubes includes a master power supply and several high-voltage modules. The master power supply is constructed and arranged to provide high-frequency and low-voltage power to the high-voltage modules. Each high-voltage module, in turn, provides high-frequency and high-voltage power to a gas discharge tube. The high-voltage modules include step-up transformers with their primary sides connected in series to the output of the master power supply and their secondary sides connected to the gas discharge tubes.

According to another aspect, a method for providing electrical power to several gas discharge tubes includes generating a high-frequency and low-voltage power signal, providing the high-frequency and low-voltage power signal via a standard electrical wire (e.g., 3 lead×14 AWG wire) to several high-voltage modules. Each high-voltage module includes a step-up transformer with a primary side and a secondary side. The method also includes receiving the high-frequency and low-voltage power signal by the high-voltage modules having the primary sides connected in series, and providing a high-frequency and high-voltage power signal from the secondary sides to the gas discharge tubes.

The system for providing electrical power may include one or more of the following. The master power supply includes an inverter type power supply. The master power supply includes a power inverter connected to an AC output current source via a transformer. The power inverter includes two bipolar transistors arranged as a Darlington pair for providing a high current gain.

The master power supply includes a ground fault detector connected to ground fault feedback circuits located in the high-voltage modules. The master power supply includes an open circuit detector. The master power supply includes a broken tube level sensor. The master power supply includes an H.F. converter output loading detector. The master power supply includes an anti-bubble circuit constructed and arranged to superimpose a square wave signal of a low-frequency onto the high-frequency and low-voltage power provided by the master power supply to the high-voltage modules. The master power supply includes an inverter fail detector. The master power supply includes a line over voltage detector. The master power supply includes a control module. The control module includes a CPU fault manager. The CPU fault manager is connected to a diagnostic indicator. The CPU fault manager is connected to a telemetry module.

According to yet another aspect, in a system for providing electrical power to several gas discharge tubes, one high-voltage module may be connectable in series with another high-voltage module. The high-voltage modules include step10 up current transformers having primary sides, connectable together in series and to an output of an inverter type power supply, and secondary sides connectable to a gas discharge tube.

The high-voltage module may include a ground fault feedback circuit constructed and arranged to provide a ground fault feedback signal to a ground fault detector. The ground fault feedback circuit may include a discharge resistor connected in parallel to a first capacitor, wherein the discharge resistor and the first capacitor are connected between an input return of the primary side and a high-voltage return of the secondary side. The ground fault feedback circuit may further include a second capacitor connected to the high-voltage return between the secondary side and the gas discharge tube. The ground fault feedback circuit further includes a third capacitor connected between the high-voltage return and a chassis ground connection. The ground fault feedback circuit includes only passive elements.

The high-voltage module may include a voltage limiter connected across the primary side of the step-up current transformer. The voltage limiter is a bi-directional zener diode. The high-voltage module enables independent brightness control for each gas discharge tube. The high-voltage module enables the same brightness for all gas discharge tubes in the system. The same high-voltage module can support gas discharge tubes of varying length.

The high-voltage module is constructed and arranged to occupy a relatively small volume and thus may be mounted next to the gas discharge tube within a letter enclosure. The high-voltage module is also constructed and arranged to have a relatively low weight. Due to the small size and low weight, the high-voltage module may be used within small letters or may be used with letters and signs having complex shapes.

According to yet another aspect, a system for providing electrical power to several gas discharge tubes includes a master power supply constructed and arranged to provide high-frequency and low-voltage power via standard electrical wires to several high-voltage modules. Each high-voltage module includes a step-up transformer constructed to receive high-frequency and low-voltage power at the primary side of the step-up transformer. The high-voltage module provides, in turn, high-frequency and high-voltage power from the secondary side of the step-up transformer to electrodes of one gas discharge tube via high-voltage wires. The individual high-voltage modules have their primary sides connected in series to the master power supply. The master power supply includes a fault detector arranged to receive a signal from a fault feedback circuit provided in each high-voltage module.

The master power supply may include a ground fault detector arranged to receive a signal from a ground fault feedback circuit provided in the high-voltage module. The ground fault detector may be a secondary ground fault level sensor constructed to sense a leakage current from the high-voltage module. The master power supply may include an inverter fail detector constructed to monitor ground connection between the high-voltage module and the power supply. The inverter fail detector may be constructed to monitor operation of a power inverter of the power supply.

The master power supply may include an open circuit detector constructed to sense an overload in the high-voltage module. The open circuit detector may be constructed to sense the overload by detecting a high-frequency current of a non-sinusoidal waveform received from the high-voltage module having a diode connected across the primary side of the step-up transformer. The master power supply may include a line over voltage detector constructed to detect a threshold value of a line voltage.

The above-designs provide novel systems that afford a high degree of safety and satisfy safety requirements of different countries (e.g., in the U.S. satisfy UL 2161, which are incorporated by reference) The novel system may be used as a highly flexible channel letter system that can be installed at a lower cost than standard channel letter systems.

DETAILED DESCRIPTION OF THE PREFERRED EMBODIMENTS

Figure 1:
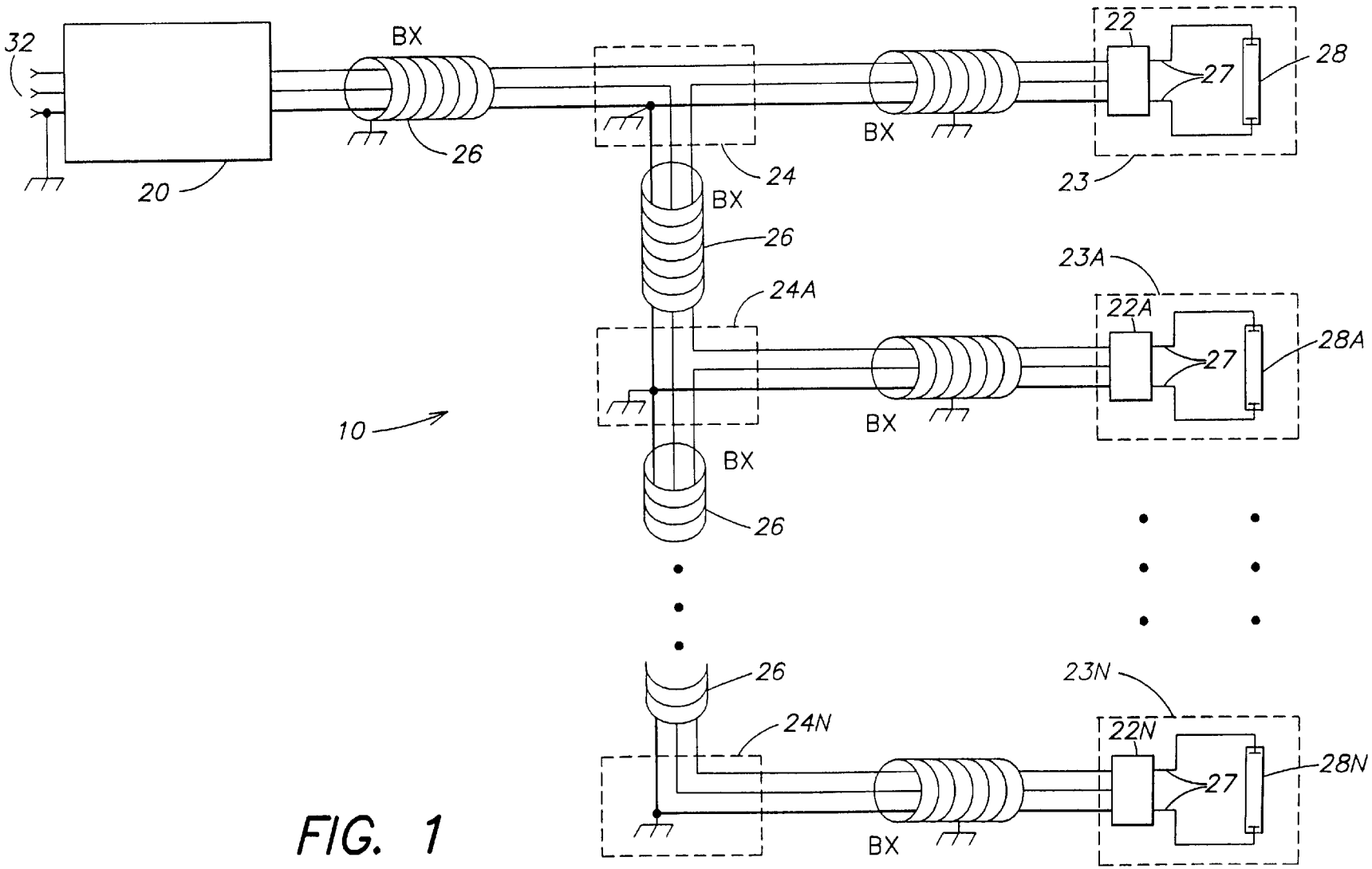
FIG. 1 shows diagrammatically an illumination system for providing electrical power to several gas discharge tubes.

Referring to FIG. 1, an illumination system 10 includes a master power supply 20 providing power to several high-voltage modules 22, 22A, . . . 22N, which in turn are connected to gas discharge tubes. Illumination system 10 may use fluorescent tubes or cold cathode tubes, for example, neon tubes or argon/mercury tubes. Master power supply 20 includes a high-frequency power converter, a control module, and several detector modules described below. The individual modules of master power supply 20 detect different states of illumination system 10, including various fault conditions of the gas discharge tubes. Specifically, master power supply 20 provides low-voltage and high-frequency power to high-voltage modules 22, 22A, . . . , 22N connected in series by a standard electrical cable using junction boxes 24, 24A, . . . 24N, respectively.

Illumination system 10 uses a metal jacketed cable 26 for connecting master power supply 20 to high-voltage modules 22, 22A, . . . , 22N. Cable 26 may be, for example, a 3×14 AWG cable inside a BX type metal conduit. Alternatively, illumination system 10 can use any standard electric cable used for interior or exterior power transmission (e.g., cable rated for 130V, 300V, or electrical cables used in automobile industry). Cable 26 electrically connects the output of master power supply 20 to primary sides of the individual step up transformers located in high-voltage modules 22, 22A, . . . 22N. Two high-voltage GTO-5 cables 27 the connect secondary side of each step up transformer to cold cathode tube 28.

Advantageously, high-voltage modules 22, 22A, . . . , 22N may be located more than 100 feet away from master power supply 20. In the preferred embodiment described in connection with FIGS. 3A through 5, high-voltage modules 22, 22A, . . . , 22N may be located up to 250 feet from master power supply 20. This distance can be increased to several hundred feet by adjusting the low-voltage and high-frequency values provide by power supply 20.

Cold cathode tubes 28 are arranged to illuminate commercial signs, billboards, or buildings. Each cold cathode tube 28 and high-voltage module 22 may be located inside a letter enclosure 23 (a box letter). Alternatively, cold cathode tubes 28, 28A, . . . , 28N are arranged to contour a selected object or area, such as a store window or a commercial symbol. High-voltage modules 22, 22A, . . . 22N have a small size and weight and thus can be located next to cold cathode tubes 28, 28A, . . . , 28N in small spaces or used in signs and with letters that have complex shapes. In general, cold cathode tubes 28, 28A, . . . , 28N and high-voltage modules 22A, . . . , 22N may be used internally or externally and arranged to illuminate a building, or a commercial sign.

Figure 2:
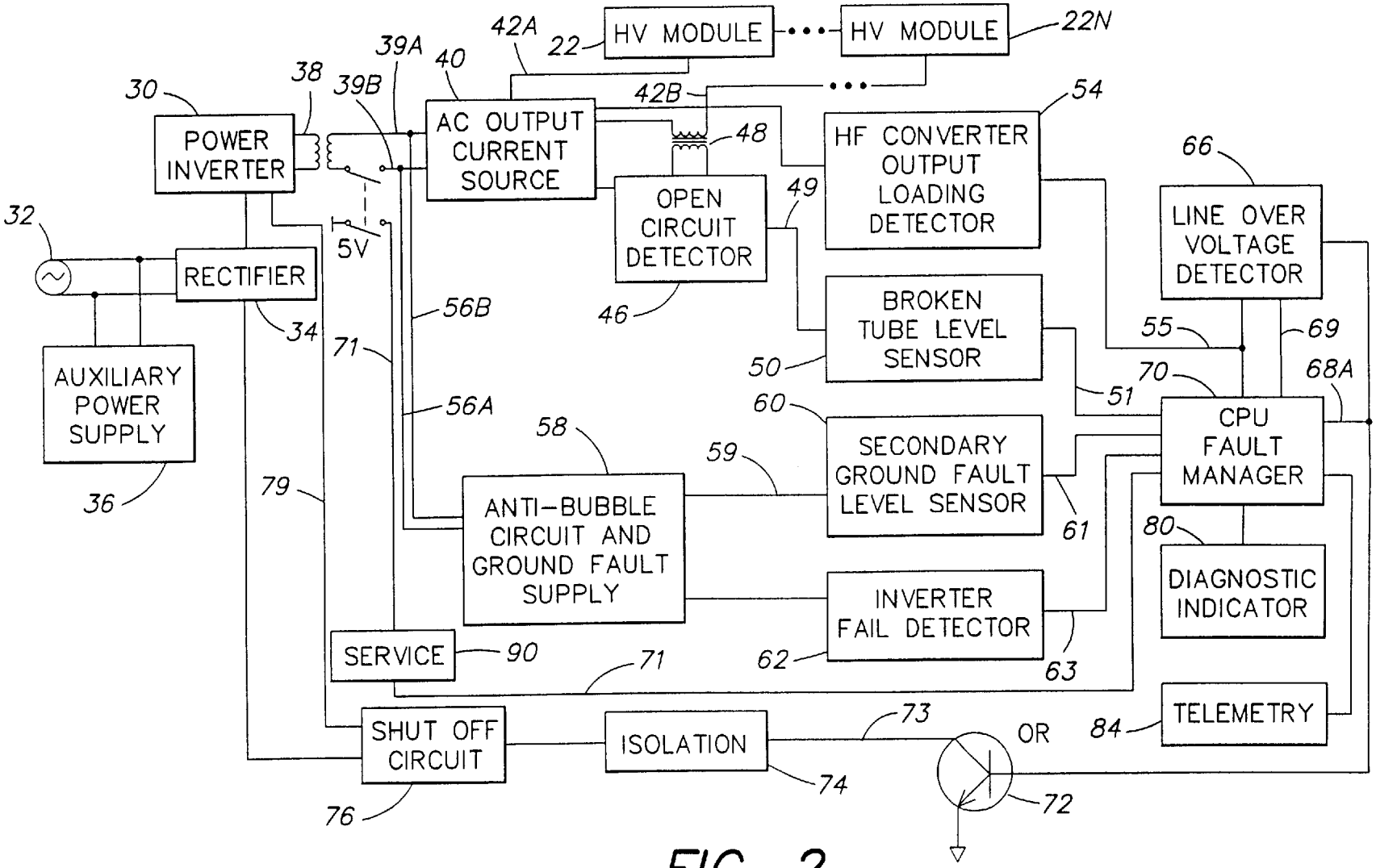
FIG. 2 is a block diagram of a master power supply used in the illumination system of FIG. 1.

Referring to FIG. 2, master power supply 20 includes a power inverter 30 connected to a rectifier 34 receiving power from a standard power outlet 32, for example, the input line voltage of 120 Volt AC at 60 Hz. Power inverter 30 is connected to an AC output current source 40 via a transformer 38. These elements form the high-frequency power converter that provides a low-voltage and high-frequency signal up to twenty high-voltage modules 22, 22A, . . . , 22N. Optionally, power inverter 30 may be connected to a DC supply without using rectifier 34.

Master power supply 20 also includes several detector modules that are an open circuit detector 46, a broken tube level sensor 50, an H.F. converter output loading detector 54, an anti-bubble circuit and ground fault supply 58, a secondary ground fault level sensor 60, an inverter fail detector 62, a line over voltage detector 66. These detector modules provide signals to a CPU fault manager 70. CPU fault manager 70 may be connected to a diagnostic indicator 80 and a telemetry 84. CPU fault manager 70 is isolated from power inverter 30 by an isolation circuit 74, which is connected to a shut-off circuit 76. An auxiliary power supply 36, also connected to standard power outlet 34, provides 15 Volt AC, +5 Volt and +12 Volt DC power to the above-listed modules and CPU fault manager 70.

Figure 3A:
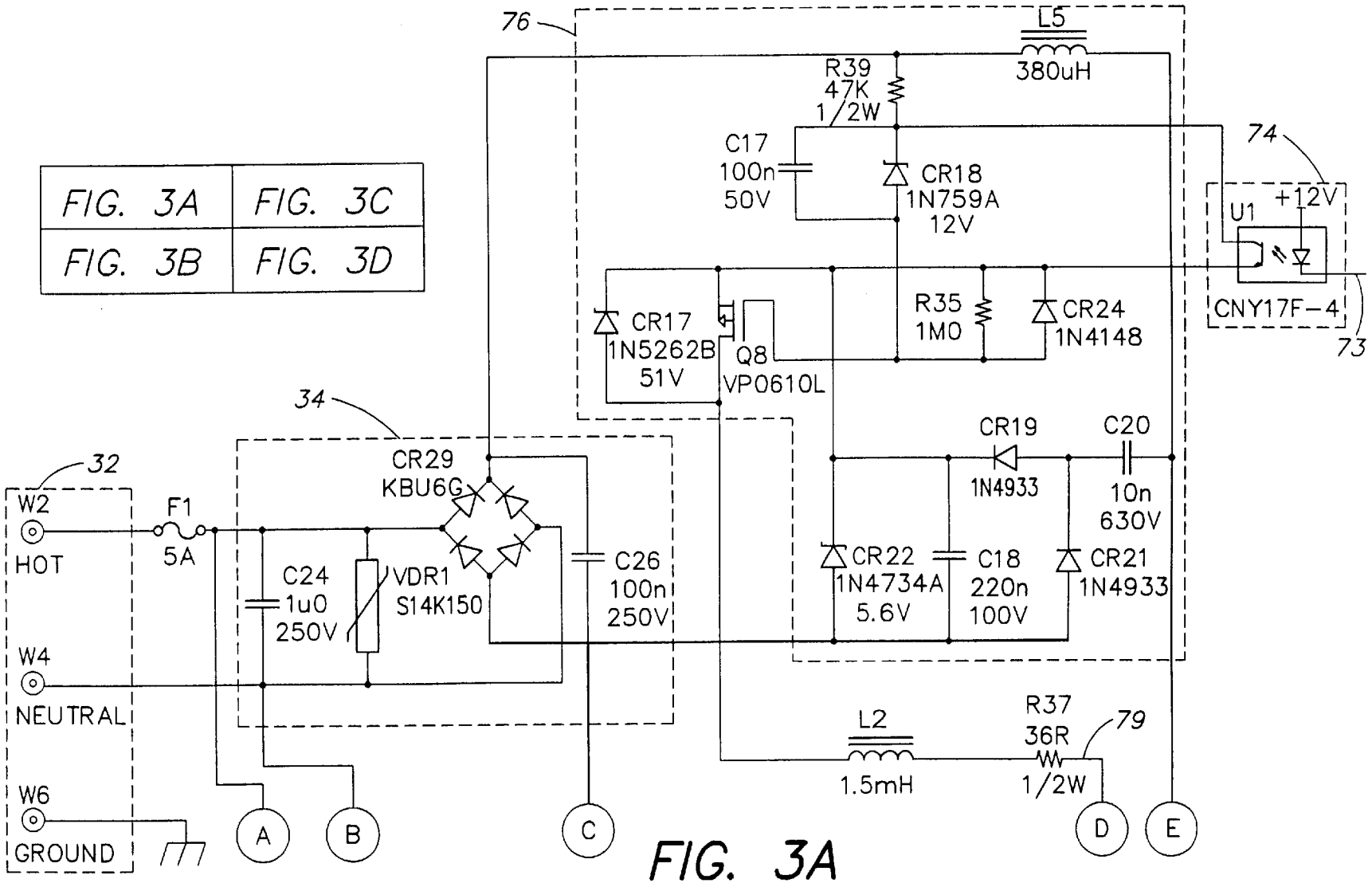
FIGS. 3A, 3B, 3C, 3D, 4A, 4B and 4C are schematic diagrams of a high-frequency power converter, detector and control modules used in the master power supply of FIG. 2.
Figure 3B:
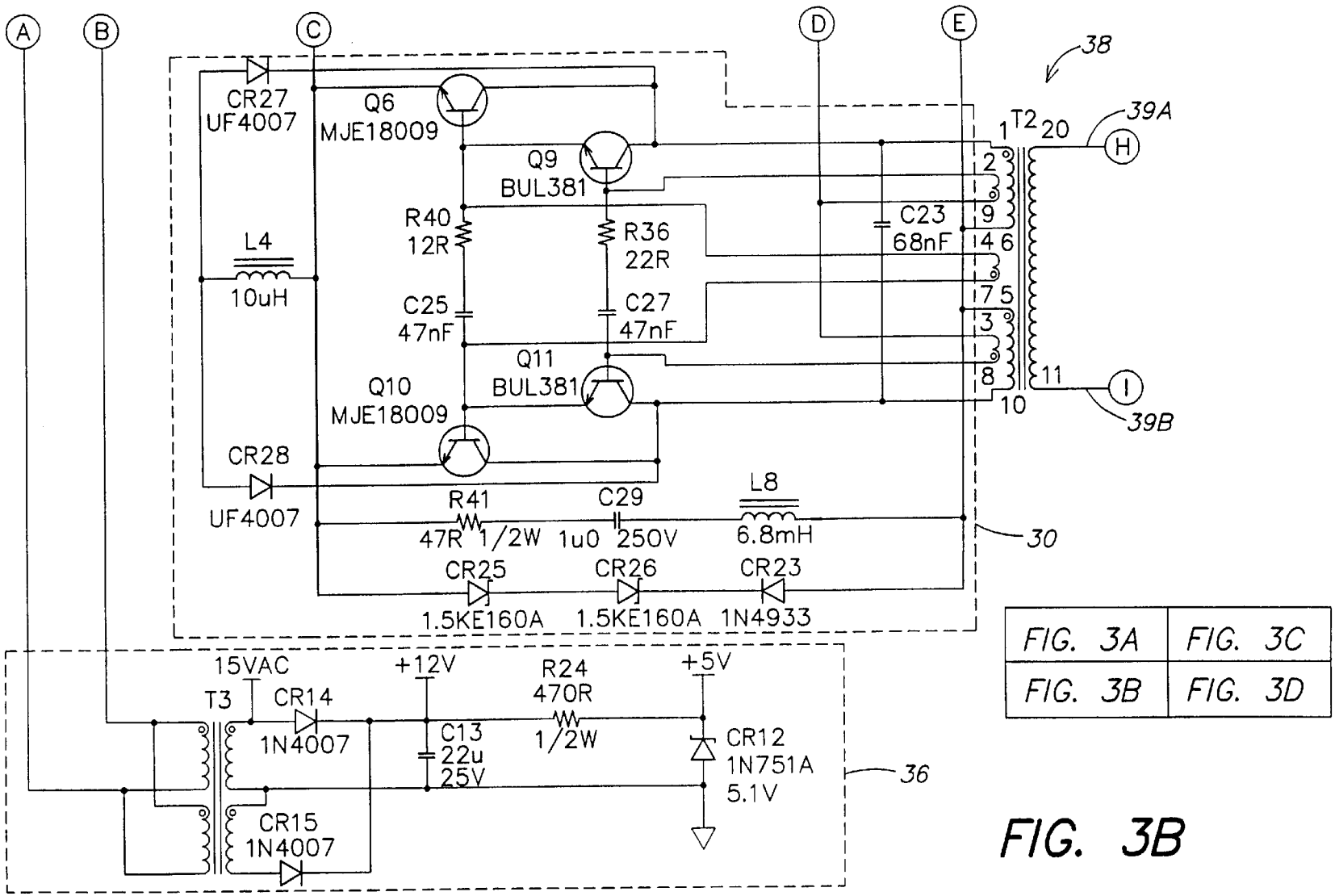

Schematic diagram of master power supply 20 is shown in FIGS. 3A through 4C. FIG. 3A shows a power outlet 32 connected to a rectifier 34. Rectifier 34 provides a full wave rectified output to shut-off circuit 76. Also referring to FIG. 3A, rectifier 32 is also connected to power inverter 30. Power inverter 30 also receives the full wave rectified output from rectifier 34, which has an input current of about 3.5 Amps (max.) at full load.

Power inverter 30 uses a sinusoidal resonant circuit topology with four bipolar transistors Q6, Q9, Q10 and Q11. Transistors Q6 and Q9 are arranged as a first Darlington pair, and transistors Q10 and Q11 as a second Darlington pair. The two pairs are turned ON and OFF and are arranged to provide a high current gain. The oscillation frequency depends on the capacitance of a capacitor C23 and the inductance of primary coils of transformer 38. The auxiliary windings of transformer 38 is used to drive the bases of transistors. Diodes CR27 and CR28 together with an inductor L4 allow fast power inverter turn OFF at anytime during the 60 Hz sign wave. To prevent transistor failure, Schottky diodes CR25 and CR26, and diode CR23 are used as a clamp that fixes voltage levels for transients.

Figure 3C:
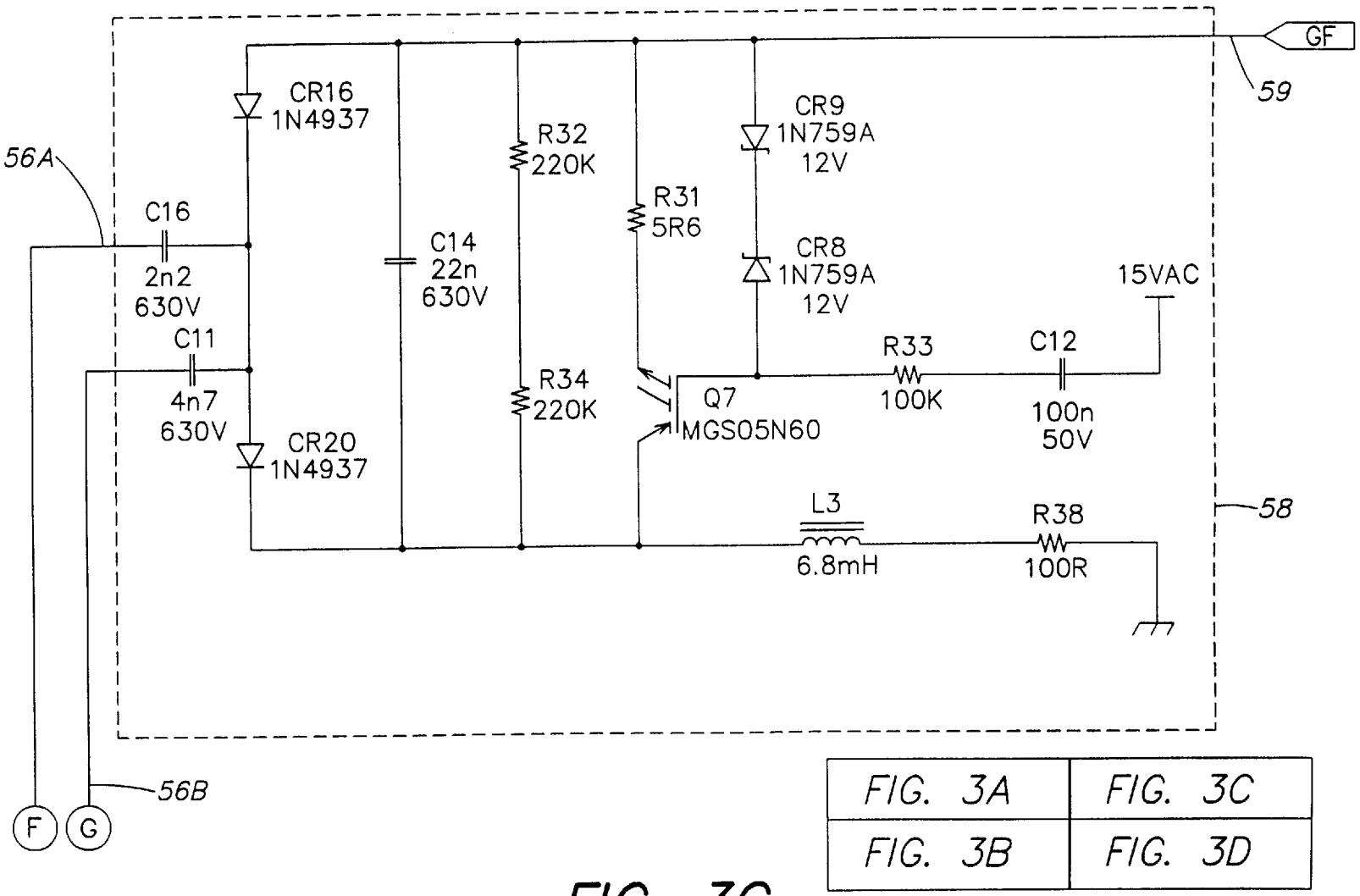
Figure 3D:
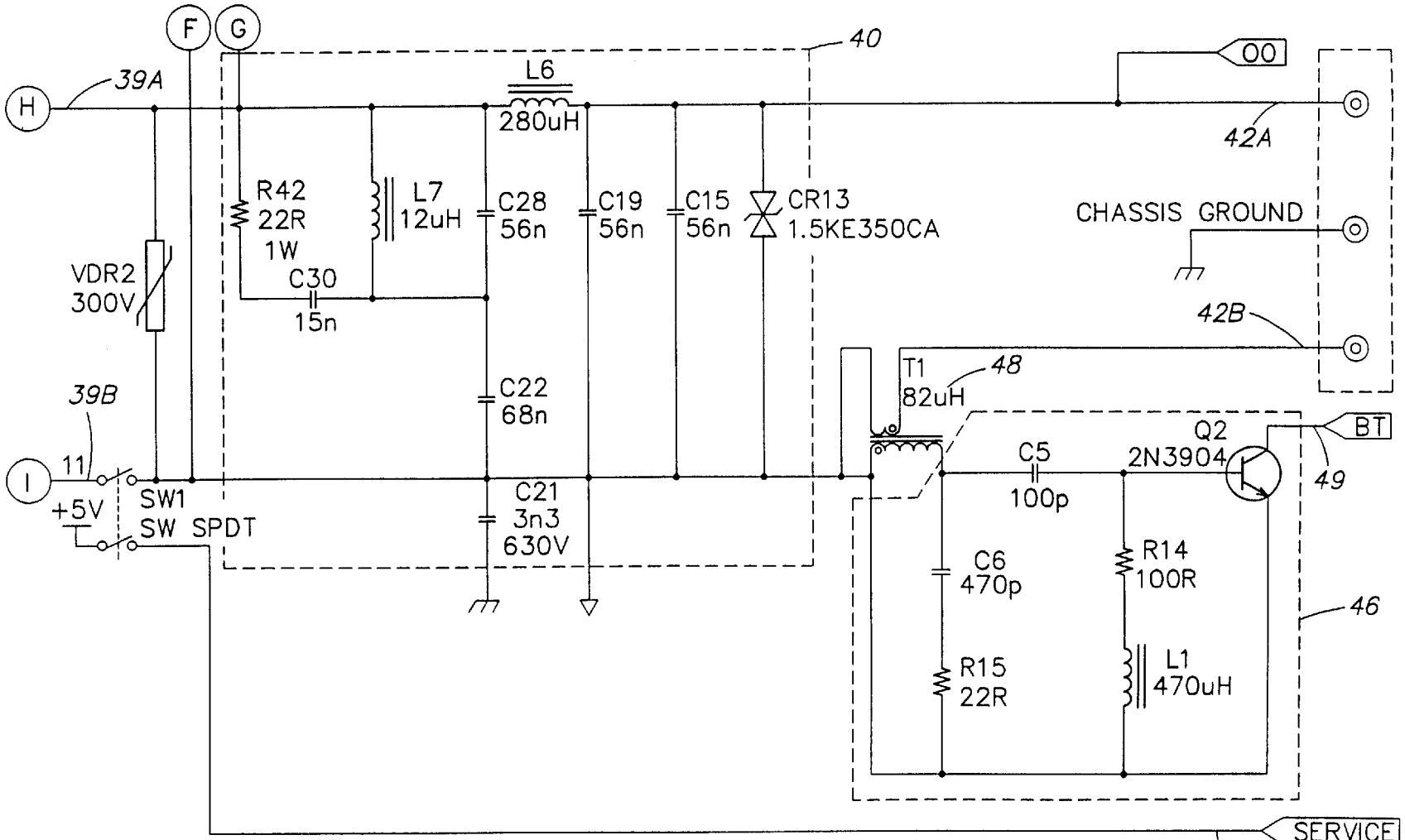

Referring to FIG. 3D, AC output current source 40 receives output from the secondary side of transformer 38 (FIG. 3B) via connections 39A and 39B. The input voltage to current source 40 depends on the ratio of the primary to secondary turns that is in the range of about 1:1 to 1:3. Preferably, the ratio of the primary to secondary coils is about 1:1. An inductor L6 (L=280 pH) converts the output voltage of transformer 38 into an AC current.

Current source 40 provides an output current of several amperes to the high-voltage modules connected in series via connections 42A and 42B. Capacitors C22 and C28 correct the power factor of inductor L6. The power factor is above 0.8 and preferably higher than 0.9. Capacitors C19, and C15 maintain a constant current for any variation of the load, i.e., cold cathode tubes 28, 28A . . . 28N. Due to the high no load voltage of the resonant circuit, CR13 is used as a voltage clamp when the AC current source is running without any load.

The output from AC output current source 40 has a sine waveform at a frequency in the range of 5 kHz to 100 kHz, or preferably in the range of 10 kHz to 50 kHz and an output voltage in the range of 10 Vac to 1000 Vac or preferably in the range of 100 Vac to 300 Vac. More preferably, AC output current source 40 provides a sine waveform power signal at the operating frequency of about 30 kHz and output voltage of about 160 Vac (max.). The output current for a shorted circuit at nominal line is in the range of 1.5 A to 7.0 A and preferably is about 3.2 A. The output current at nominal line is in the range of 1.0 A to 6.0 A and preferably is about 2.6 A for a full load providing a maximum output power preferably about 350 Watts at the full load. The full load is about 85 feet and 110 feet for a neon tube of 12 mm and 15 mm in diameter, respectively.

Referring again to FIGS. 2 and 3A, when CPU fault manager 70 registers a fault condition, it provides a signal to shut-off circuit 76. Shut-off circuit 76 eliminates, in turn, the necessary voltage provided to the power inverter base drive formed by transistors Q9 and Q11 via connection 79. Shut-off circuit 76 receives power from rectifier 34 and builds up power across a diode CR22, a resistor R39, a diode CR18, and a diode CR24. As soon as power inverter 30 is turned on, auxiliary supply, formed by a capacitor C20 and diodes CR21 and CR19 takes over that function.

Isolation circuit 74, shown in FIG. 3A, can use an opto-coupler, a transformer or a similar device. Preferably, isolation circuit 74 includes an opto-coupler U1 for protecting CPU fault manager 70, which is floating. The input 73 to opto-coupler is refreshed (i.e., turned ON-OFF-ON) at each 60 Hz zero crossing to maintain power inverter 30 functional. Shut-off circuit 76 charges a capacitor C17 when opto-coupler is OFF and discharges capacitor C17 through a resistor R35 to turn on a transistor Q8 when opto-coupler U1 is ON.

Referring to FIGS. 2 and 3C, anti-bubble circuit and ground fault supply module 58 has two functions. Module 58 removes the "bubble" or "Jelly bean" effect caused by gas resonance when using a high-frequency power supply with a neon gas tube. Furthermore, module 58 provides a 60 Hz and 0 to 400V square wave to secondary ground fault level sensor 60 (FIG. 4B). This square wave modifies the output waveform symmetry by adding a 60 Hz modulation. The DC component of the square wave provides an offset to the high-voltage power signal received by tube 28, and the offset is used by the ground detection circuit.

Specifically, anti-bubble circuit and ground fault supply module 58 is connected to the secondary coil of transformer 38 using connections 56A and 56B. The AC signal from the secondary coil is reduced by capacitors C11 and C16 and is then rectified by diodes CR16 and CR20 to provide a DC voltage across a capacitor C14. A transistor Q7 is turned ON at 60 Hz using a 15 Vac signal from auxiliary supply 36 (FIG. 3B) to produce a square wave having 0 V to 400V at 60 Hz. Diodes CR9 and CR8 and a resistor R31 are arranged to configure transistor Q7 to operate as a limited current source and provide a square wave output at a connection 59.

Figure 5:
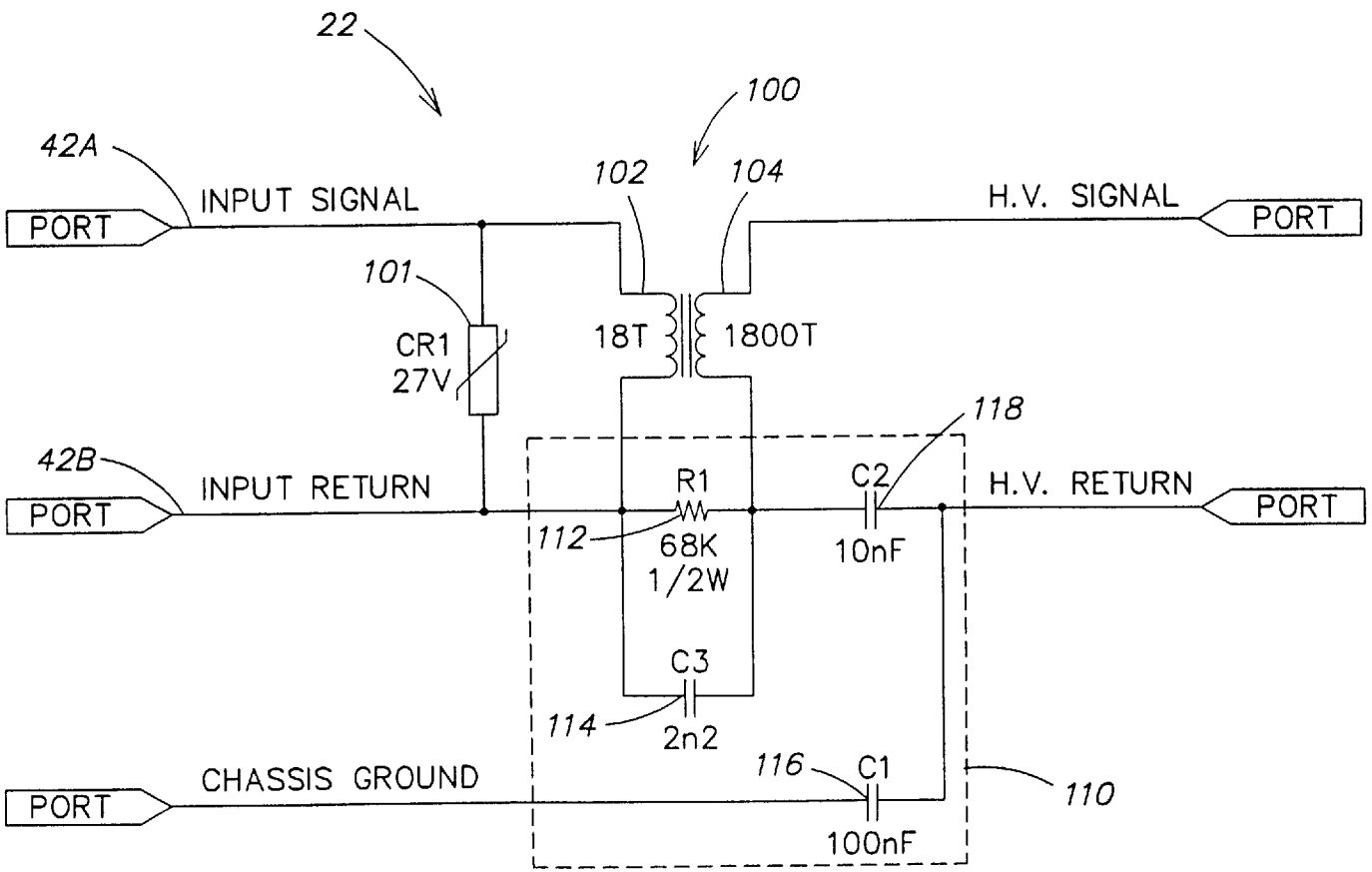
FIG. 5 is a schematic diagram of a high-voltage module used in the illumination system of FIG. 1.

Referring to FIG. 5, each high-voltage module 22, . . . , 22N includes a step-up transformer 100 and a ground fault feedback circuit 110. Step-up transformer 100 is a high-frequency current transformer having a primary side 102 and a secondary side 104 with a selected turn ratio. The turn ratio may be one to several hundred and is preferably 1 to 100. Primary side 102 receives from AC output current source 40 a current of about 3 A and develops a voltage of about 20 V. When step-up transformer 100 is running in open load, a bi-directional zener diode 101 limits the primary voltage to about 27 V. During normal operation, secondary side 104 can provide a high-voltage output up to 20 kV depending on the construction of AC current source 40, the turn ratio of transformer 100, and zener diode 101. The high-voltage output may be in the range of about 1 kV to 10 kV, and preferably 2 kV and a current of about 30 mA (up to 120 mA), which is supplied to cold cathode tube 28. Ground fault feedback circuit 110 includes a discharge resistor 112 connected in parallel to a capacitor 114. This parallel arrangement which connects input return 42B, is at zero volt, to secondary 104. Capacitor 118 is connected across the H.V. return and capacitor 116 connects the H.V. return to the chassis ground.

Figure 5A:
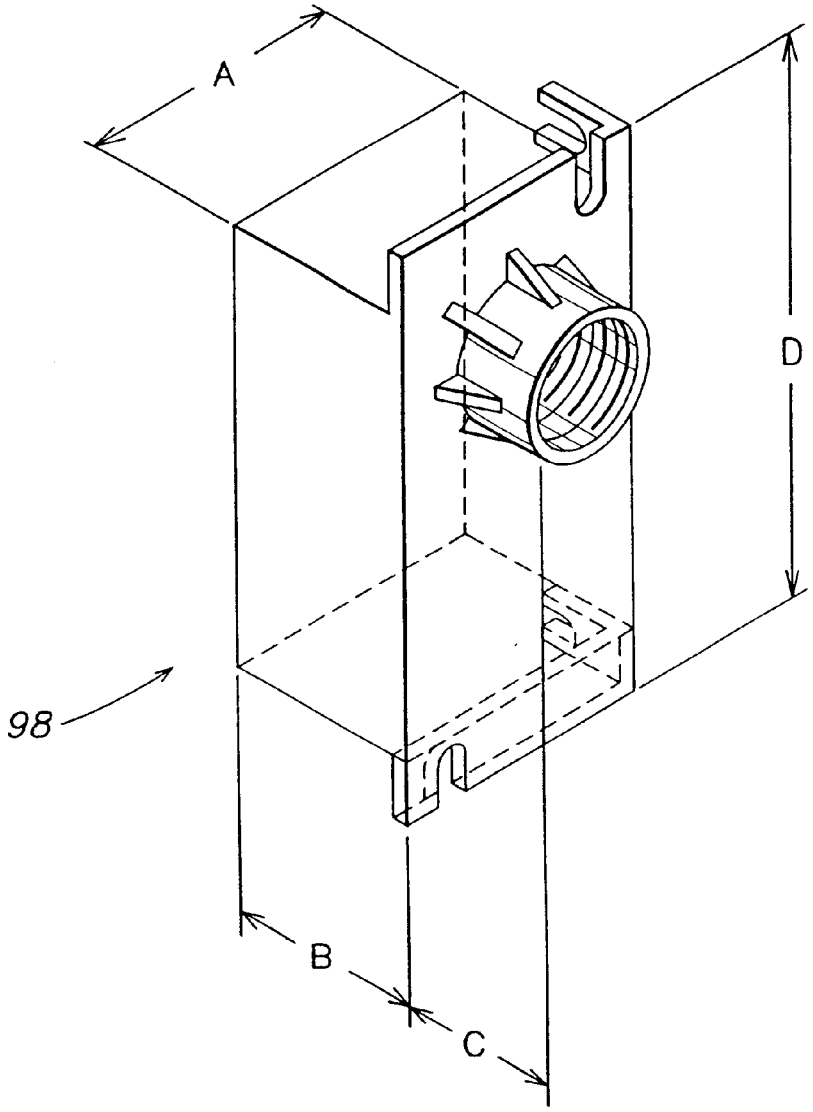
FIG. 5A is a perspective view of an enclosure for the high-voltage module shown in FIG. 5.

High-voltage module 22, shown in FIG. 5, is located in an H.V. module enclosure 98 shown in FIG. 5A. A printed wiring board carrying the individual elements is located inside a polymeric enclosure and casted with a polyurethane compound that encloses all current-carrying parts. A female thread insert is used to connect the primary leads that may be 3×14 AWG wires enclosed in a ⅜ flexible metal conduit. Two GTO5 cables 27 provide the secondary connection to tube 28 as described above. The GTO5 cables are approximately 12 inches long. High-voltage module 22 is designed for indoor and outdoor non-weatherproof channel letter applications. For outdoor application, high-voltage module 22 must be located inside a letter enclosure. H.V. module enclosure 98 is approximately 2.4 inches long, approximately 1.6 inches wide, and has approximately 1 inch height. The weight of high-voltage module 22 is about 4 ounces. The small size and weight are advantageous for use in signs and letters that have complex shapes.

Referring to FIGS. 2 and 4B, secondary ground fault sensor 60 senses a leakage current from the input coil or the output coil of any of high-voltage modules 22, . . . , 22N shown in FIG. 5. Secondary ground fault sensor 60 receives the square wave from module 58 (FIG. 3C) via connection 59. During normal operation, the voltage across a capacitor C10 is positive and larger than +5V. When the input or the output of high-voltage module 22 is shorted to ground, capacitor C10 is discharged through resistor 112 inside the high-voltage module (FIG. 5). Then the voltage across C10 decreases to a voltage below the +5V DC reference. As the voltage across C10 decreases, a comparator U4C (FIG. 4B) provides an output that changes from a voltage of about +5V DC to a voltage 0 V DC. This ground fault status signal is provided to CPU fault manager 70 (FIG. 4C) via a connection 61.

Referring again to FIGS. 2 and 4B, inverter fail detector 62 monitors proper connection of the ground wire from AC output current source 40 to high-voltage modules 22, . . . , 22N and also monitors proper operation of power inverter 30. A resistor R5, connected to +5 V from auxiliary power supply 36, and resistor R6 connected to zero volts are used to build up a reference voltage. The square wave from module 58 and capacitor 116 (FIG. 5) connected to ground produce a voltage greater than a reference threshold voltage, which is set to about 200 mV. The output 63 is a square wave when the input AC signal from module 58 is present. As soon as the AC signal is below the threshold value, the output 63 remains high and is detected as a fault condition of inverter 30.

Referring again to FIGS. 2 and 4A, high-frequency converter and output loading detector 54 is used to measure the output loading of master power supply 20. Detector 54 provides a falling edge pulse width proportional to the high-frequency converter output loading at each 60 Hz zero crossing. The pulse duration is function of the peak of the output voltage present at the anode of a diode CR10 connected to resistors R25 and R18, which are connected to zero Volts.

Figure 4A:
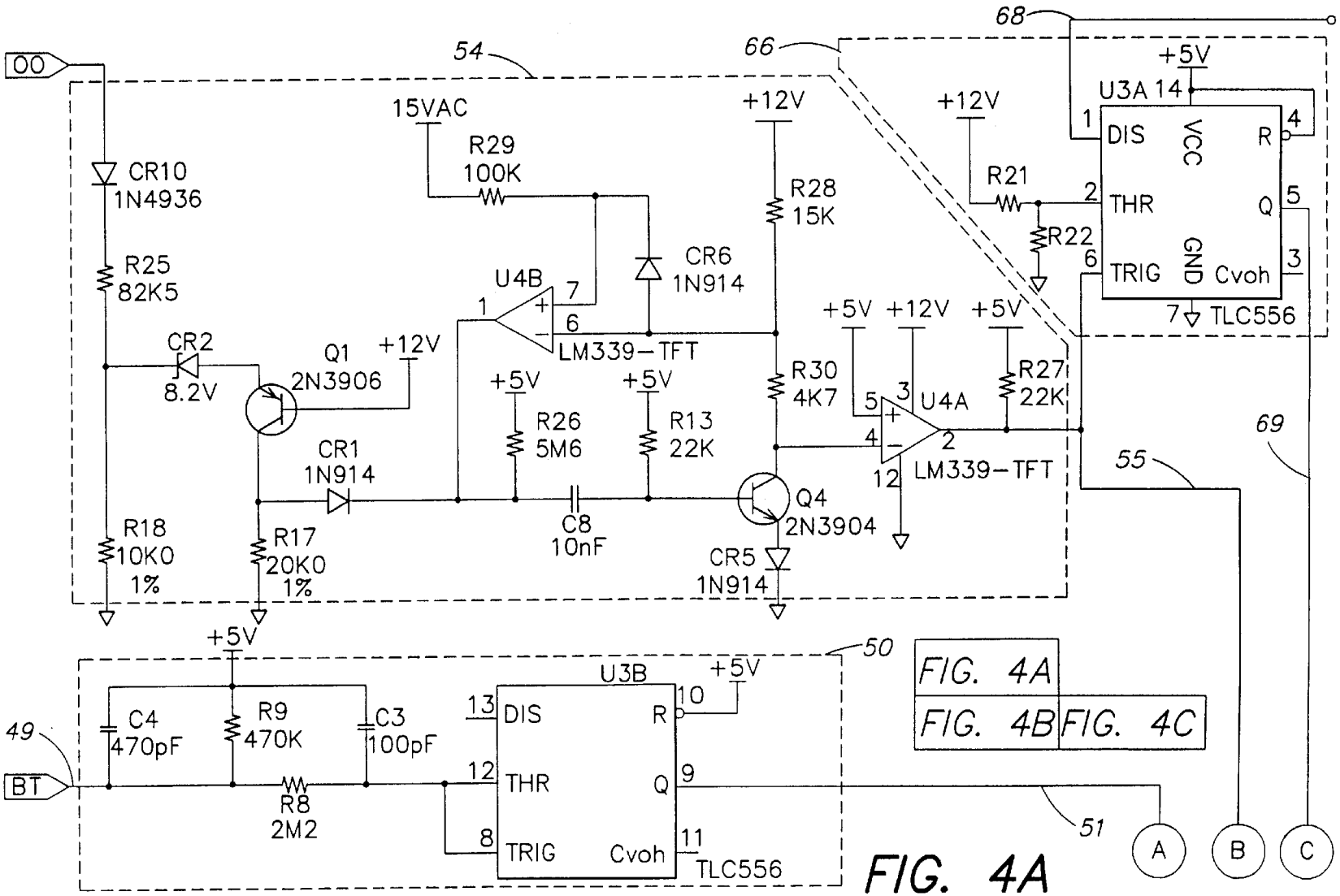
Figure 4B:
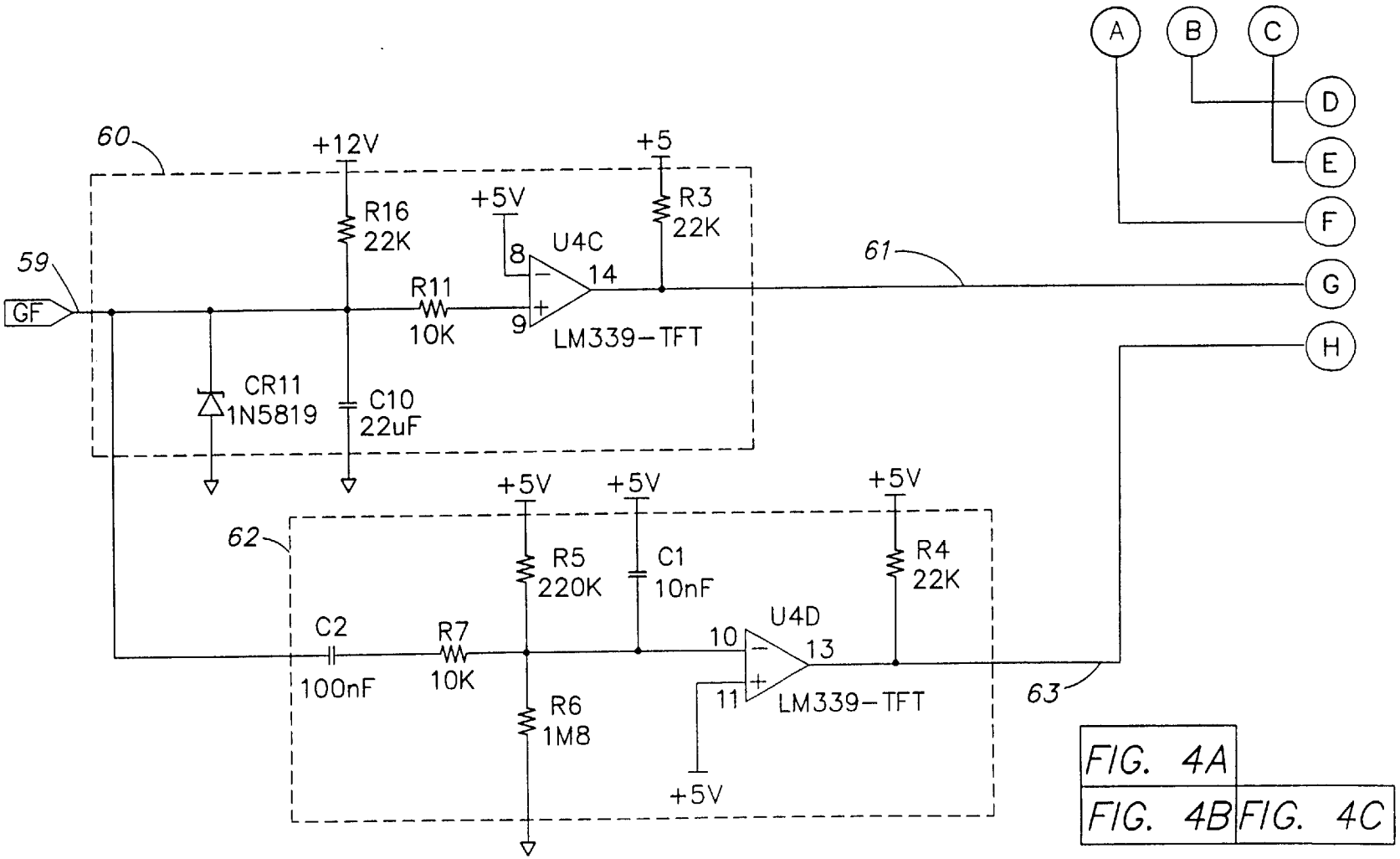
Figure 4C:
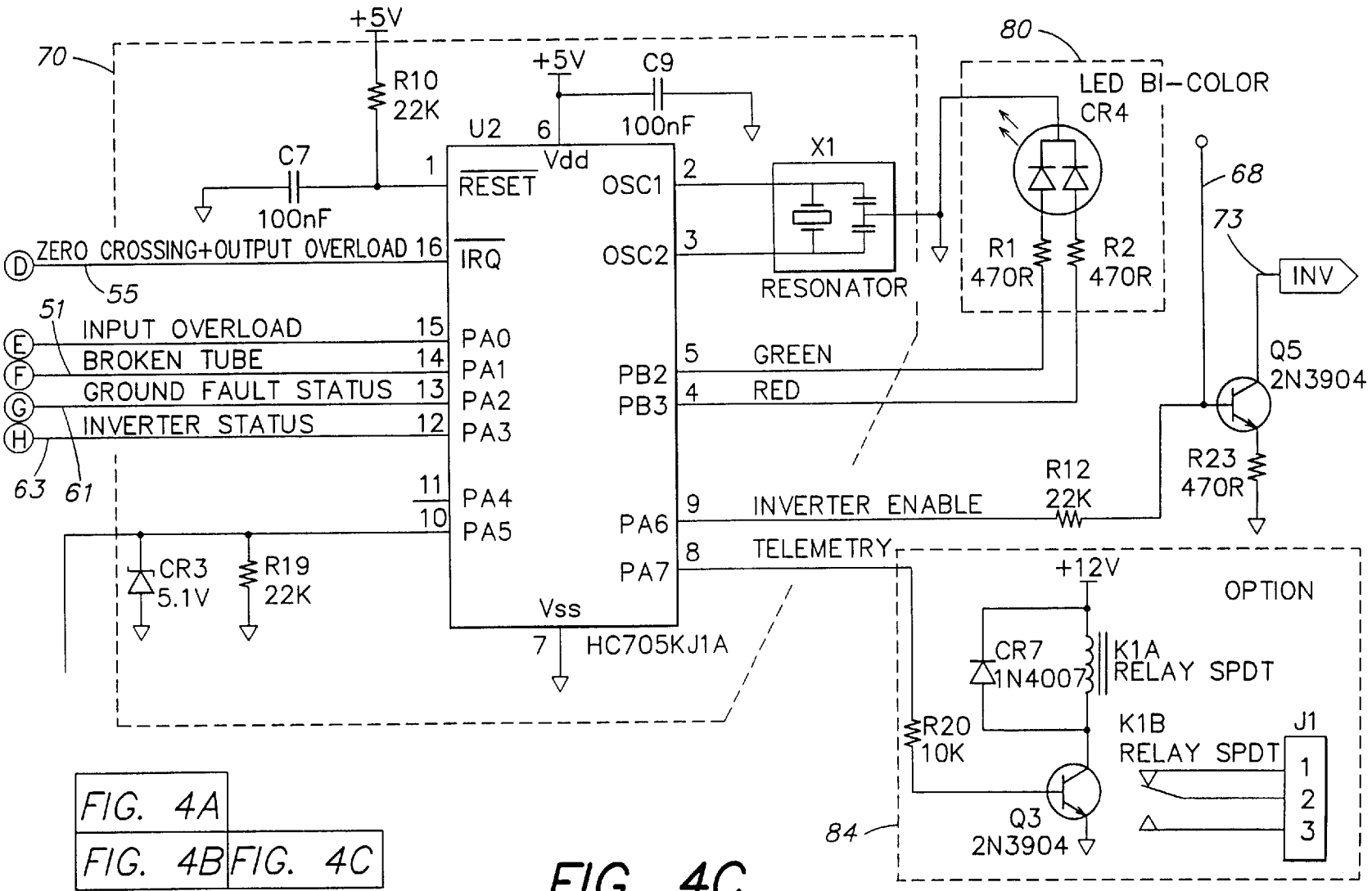

Referring to FIG. 4A, a comparator U4B synchronizes the pulse with the zero crossing. Comparator U4B is connected to resistor R29, which receives 15 V AC. Comparator U4B is connected to resistors R28 and R30, which provide threshold references and give the signal before the true zero crossing. The minimum pulse width is determined by the voltage charge across a capacitor C8, connected between the output of comparator U4B and transistor Q4, and the time constant of capacitor C8 and resistors R13 and R26 connected to +5 V. The pulse width duration remain the same until the voltage across the divider made from resistors R25 and R18 reaches the zener voltage of a zener diode CR2. This zener voltage is added to the base emitter voltage of transistor Q1. At this time, transistor Q1 provides a voltage higher than +0.7 V DC at the cathode of a diode CR1. Then, the current charges across capacitor C8 as the next zero crossing occurs. Capacitor C8 discharges through resistor R13 and generates a pulse with a width that is proportional to the output peak voltage. Thus, comparator U4A provides a falling edge pulse width proportional to the high-frequency converter output loading, at each 60 Hz zero crossing. This zero crossing output overload signal is provided to CPU fault manager 70, shown in FIG. 4C.

Referring to FIG. 4A, a line over-voltage detector 66 includes two timers packaged as TLC556. Line over-voltage detector 66 is used to turn OFF power inverter 30 when the line voltage exceeds a threshold value determined by a resistor R21, connected to +12V and resistor R22 connected to zero. The output 68 from line over-voltage detector 66 and the output 68A from CPU fault manager 70 turn OFF a transistor Q5, shown in FIG. 4C. Transistor Q5 provides an output via connection 73 to opto-coupler U1, shown in FIG. 3A. Furthermore, line over-voltage detector 66 provides the output 69 to CPU fault manager 70. The output 69 specifies an input overload.

Referring to FIG. 2, transistor Q5 acts as an amplifier and as an OR gate 72, receiving signals from over-voltage detector 66 and CPU fault manager 70. The amplified signal is isolated from the primary side of transformer 38 (FIG. 3B) using isolation 74 (i.e., opto-coupler U1, shown in FIG. 3A).

Referring to FIGS. 2 and 3D, open circuit detector 46 detects a broken tube that causes a voltage overload in any high-voltage module 22 due to the open circuit condition. Open circuit detector 46 senses high-frequency current having a non-sinusoidal waveform using transformer 48 connected to a return 42B. The non-sinusoidal waveform arises from a current spike generated by the voltage clamping of bi-directional zener diode 101 connected across primary coil 102 of high-voltage module 22 (FIG. 5). Open circuit detector 46 includes capacitors C5 and C6, resistors R15 and R14 and inductance L1 connected to the base of a transistor Q2. The high-frequency current, induced in transformer 48, is filtered by capacitors C5 and C6, resistors R15 and R14 and inductance L1. The resulting signal turns ON transistor Q2, which provides a signal via a connection 49 to broken tube level sensor 50 shown in FIG. 4A Referring to FIG. 4A, broken tube level sensor 50 guarantees that any broken tube narrow pulse will be extended for a selected time so that CPU fault manager 70 can register the information. The selected time depends on the time constant of a capacitor C4 and a resistor R9 connected to +5 V. A resistor R8 and a capacitor C3 provide a time constant of U3B output. Thus, broken tube level sensor 50 provide a minimum pulse width to the broken tube fault signal send to CPU fault manager 70 via a connection 51.

Referring to FIG. 4A, CPU fault manager 70 is an 8 bit micro controller, which manages all functions including, fault management, power inverter control, telemetry control, and two different modes of operation. CPU fault manager 70 provides an indication signal to a diagnostic indicator 80.

Diagnostic indicator 80 includes a bicolor LED used to indicate different statuses of the system. The green color indicates safe operation, the yellow color indicates unsafe operation and the red color indicates a fault condition. Each flashing sequence is repeated after a 4 seconds OFF delay in a normal mode, and with a 2 seconds OFF delay in a service mode. Diagnostic indicator 80 can indicate the tube length, the number of high-voltage module and the cable length between the master power supply 20 because these factors influence the output power. For example, during safe operation one green flash can indicate 0% to 79% load, two green flashes can indicate 80% to 84% load, three green flashes can indicate 85% to 89% load, four green flashes can indicate 90% to 94% load, and five green flashes can indicate 95% to 99% load. During unsafe operation, one yellow flash can indicate 100% to 104% load, two yellow flashes can indicate 105% to 109% load, three yellow flashes can indicate 110% to 114% load, and four yellow flashes can indicate 115% to 119% load.

If the LED flashes red, the output power is more than 120%. Thus, he number of flashes of the same color may refer to a selected power loading indication. Similarly, the number of flashes may refer to a selected fault condition according to the following example:

The LED will flash red one time to indicate the broken tube condition or the high-voltage module overload condition. This fault occurs, when the tube loading of an HV module 22 has exceeded or if the output of HV module 22 is open by a broken tube condition. As soon as this fault is detected, shut-off circuit 76 will shutdown inverter 30.

The LED will flash red two times to indicate the output overload condition or master power supply output open condition. This fault occurs when master power supply 20 exceeds the maximum power by more than 20%, or master power supply 20 is running in the open load condition. As soon as the fault is detected, shut-off circuit 76 will shutdown inverter 30.

The LED will flash red three times to indicate the ground fault condition. This fault occurs, when a current is flowing from any input or output of HV module 22 to chassis ground. The threshold point and the response time are variable with the number of HV module 22 being used. However, the worst case condition are less than 500 mS response time for a leakage current of 15 mA. As soon as the fault is detected, shut-off circuit 76 will shutdown inverter 30.

The LED will flash red four times to indicate the input overload condition. This fault occurs when the incoming line exceeded 140 Vrms. As soon as the incoming line exceeded that limit for more than 1 second, the brightness level will decrease and shut-off circuit 76 will shut down inverter 30.

The LED will flash red five times to indicate the inverter fail condition or the HV module ground open condition. This fault occurs when the electronic power circuitry is defective or when the electrical ground connection between the HV Module is open. As soon as the fault is detected, shut-off circuit 76 will shutdown inverter 30.

Referring to FIG. 4A, telemetry 84 includes a transistor Q3 connected to a relay SPDT. The relay can be activated if after 3 automatic resets the fault is still there. This function is applicable only if master power supply 20 is running in the normal mode. The relay will never be activated in the service mode.

After detecting any of the above-described fault conditions, CPU fault manager 70 will automatically direct three resets and then shut down power inverter 30. Next, when switch 37 is turned ON, the system automatically enters a service mode. In the service mode, the system will automatically undergo the above-described resets for thirty (30) minutes. During this time an operator can cure the corresponding fault condition, such as replace a broken tube.

Having thus described the invention and various illustrative embodiments and uses as well as some of its advantages and optional features, it will be apparent that such embodiments are presented by way of example only and not by way of limitation. Those persons skilled in the art will readily devise further modifications developments and enhancements to and improvements on these embodiments, such as variations on the disclosed methods and systems, as well as additional embodiments, without departing from the spirit and scope of the invention. Accordingly, the invention is limited only as defined in the following claims and their equivalents.

What is claimed is:

1. A system for providing electrical power to several gas discharge tubes, comprising a master power supply constructed and arranged to provide high-frequency and low-voltage power via standard electrical wires to several high-voltage modules, each the high-voltage module including a step-up transformer constructed to receive the high-frequency and low-voltage power in a primary side of the step-up transformer and provide high-frequency and high-voltage power from a secondary side of the step-up transformer to electrodes of a gas discharge tube via high-voltage wires, the high-voltage modules having their primary sides connected in series to the master power supply, the master power supply including a detector module constructed and arranged to receive a signal from a fault feedback circuit provided in each the high-voltage module.

2. The system of claim 1 wherein said fault feedback circuit of said high-voltage module includes a ground fault feedback circuit, and said detector of said master power supply includes a ground fault detector arranged to receive a signal from said ground fault feedback circuit.

3. The system of claim 1 wherein said detector of said master power supply includes a secondary ground fault level sensor constructed to sense leakage current from said high-voltage module.

4. The system of claim 1 wherein said detector of said master power supply includes an inverter fail detector constructed to monitor a ground connection between said high-voltage module and said power supply.

5. The system of claim 1 wherein said detector of said master power supply includes an inverter fail detector constructed to monitor operation of a power inverter of said power supply.

6. The system of claim 1 wherein said detector of said master power supply includes a line over voltage detector constructed to detect a threshold value of a line voltage.

7. The system of claim 1 wherein said detector of said master power supply includes an open circuit detector constructed to sense an overload arising from said high-voltage module.

8. The system of claim 7 wherein said open circuit detector is constructed to sense said overload by detecting a high-frequency current of a non-sinusoidal waveform received from said high-voltage module having a diode connected across said primary side.

9. A method of operating a power supply connected to several gas discharge tubes, including:

generating a high-frequency and low-voltage power signal by an inverter type power supply;

providing the high-frequency and low-voltage power signal via a standard electrical wire to several high-voltage modules, each said high-voltage module including a step-up transformer with a primary side and a secondary side, said high-voltage modules having the primary sides connected in series to the inverter type power supply;

providing a high-frequency and high-voltage power signal from the secondary sides to gas discharge tubes;

providing fault feedback circuits connected to said step-up transformers of said high-voltage modules;

providing a detector module in said power supply; and receiving by said detector module a condition signal indicating operation of said power supply and said high-voltage modules.

10. The method of claim 9 further including automatically altering operation of said power supply based on said condition signal.

11. The method of claim 9 wherein said condition signal indicates a ground fault status.

12. The method of claim 9 wherein said condition signal corresponds to a leakage current.

13. The method of claim 9 wherein said condition signal corresponds to a connection between said high-voltage module and said power supply.

14. The method of claim 9 wherein said condition signal corresponds to operation of a power inverter of said power supply.

15. The method of claim 9 wherein said condition signal corresponds to an overload arising from said high-voltage module.

16. The method of claim 9 wherein said condition signal corresponds to a threshold value of a line voltage provided to said power supply.

17. In a system for providing electrical power to several cold cathode gas discharge tubes, a high-voltage module connectable in series with another high-voltage module, said high-voltage modules comprising step-up current transformers having primary sides, connectable together in series and to an output of an inverter power supply, and having secondary sides connectable to a gas discharge tube.

18. In a system for providing electrical power to several cold cathode tubes, a high-voltage module connectable in series with another high-voltage module, said high-voltage modules comprising step-up current transformers having primary sides, connectable together in series and to an output of an inverter power supply, and having secondary sides connectable to a gas discharge tube further including a ground fault feedback circuit constructed and arranged to provide a ground fault feedback signal to a ground fault detector.

19. The high-voltage module of claim 18 wherein said ground fault feedback circuit includes a discharge resistor connected in parallel to a first capacitor, said discharge resistor and said first capacitor are connected between an input return of said primary side and a high-voltage return of said secondary side.

20. The high-voltage module of claim 18 wherein said ground fault feedback circuit includes only passive elements.

21. The high-voltage module of claim 19 wherein said ground fault feedback circuit further includes a second capacitor connected to said high-voltage return between said secondary side and said gas discharge tube.

22. The high-voltage module of claim 21 further including a chassis ground connection and wherein said ground fault feedback circuit further includes a third capacitor connected between said high-voltage return and said chassis ground connection.

23. In a system for providing electrical power to several cold cathode tubes, a high-voltage module connectable in series with another high-voltage module, said high-voltage modules comprising step-up current transformers having primary sides, connectable together in series and to an output of an inverter power supply, and having secondary sides connectable to a gas discharge tube further including a voltage limiter connected across said primary side of said step-up current transformer.

24. The high-voltage module of claim 23 wherein said voltage limiter is a bi-directional zener diode.

25. In a system for providing electrical power to several cold cathode tubes, a high-voltage module connectable in series with another high-voltage module, said high-voltage modules comprising step-up current transformers having primary sides, connectable together in series and to an output of an inverter power supply, and having secondary sides connectable to a gas discharge tube, said high voltage module being constructed and arranged for mounting next to said gas discharge tube within a letter enclosure.

26. In a system for providing electrical power to several cold cathode tubes, a high-voltage module connectable in series with another high-voltage module, said high-voltage modules comprising step-up current transformers having primary sides, connectable together in series and to an output of an inverter power supply, and having secondary sides connectable to a gas discharge tube said high voltage module being constructed and arranged to enable independent brightness control for each gas discharge tube.

27. In a system for providing electrical power to several cold cathode tubes, a high-voltage module connectable in series with another high-voltage module, said high-voltage modules comprising step-up current transformers having primary sides, connectable together in series and to an output of an inverter power supply, and having secondary sides connectable to a gas discharge tube, said high voltage module being constructed and arranged such that all gas discharge tubes receiving power from said inverter power supply have the same brightness.

28. In a system for providing electrical power to several gas discharge tubes, a high-voltage module connectable in series with another high-voltage module, said high-voltage modules comprising step-up current transformers having primary sides, connectable together in series and to an output of an inverter power supply, and having secondary sides connectable to a gas discharge tube, the high-voltage module further including a ground fault feedback circuit constructed and arranged to provide a ground fault feedback signal to a ground fault detector.

29. The high-voltage module of claim 28 wherein said ground fault feedback circuit includes a discharge resistor connected in parallel to a first capacitor, said discharge resistor and said first capacitor are connected between an input return of said primary side and a high-voltage return of said secondary side.

30. The high-voltage module of claim 29 wherein said ground fault feedback circuit further includes a second capacitor connected to said high-voltage return between said secondary side and said gas discharge tube.

31. The high-voltage module of claim 30 further including a chassis ground connection and wherein said ground fault feedback circuit further includes a third capacitor connected between said high-voltage return and said chassis ground connection.

32. The high-voltage module of claim 28 further including a voltage limiter connected across said primary side of said step-up current transformer.

33. The high-voltage module of claim 32 wherein said voltage limiter is a bi-directional zener diode.

34. The high-voltage module of claim 28 constructed and arranged for mounting next to said gas discharge tube within a letter enclosure.

35. The high-voltage module of claim 28 wherein said ground fault feedback circuit includes only passive elements.

36. The high-voltage module of claim 28 constructed and arranged to enable independent brightness control for each gas discharge tube.

37. The high-voltage module of claim 28 constructed and arranged such that all gas discharge tubes receiving power from said inverter power supply have the same brightness.

* * * * *